US007240605B2

(12) United States Patent
Glisenti

(10) Patent No.: US 7,240,605 B2
(45) Date of Patent: Jul. 10, 2007

(54) ACTUATOR WITH A VARIABLE RUN

(75) Inventor: Massimo Glisenti, Prevalle (IT)

(73) Assignee: Camozzi S.p.A, Brescia (IT)

( * ) Notice: Subject to any disclaimer, the term of this patent is extended or adjusted under 35 U.S.C. 154(b) by 39 days.

(21) Appl. No.: 11/174,295

(22) Filed: Jul. 1, 2005

(65) Prior Publication Data

US 2006/0005696 A1 Jan. 12, 2006

(30) Foreign Application Priority Data

Jul. 5, 2004 (IT) ..... MI2004A1343

(51) Int. Cl.
*F01B 1/00* (2006.01)

(52) U.S. Cl. ..... 92/15; 92/18; 92/131

(58) Field of Classification Search ..... 92/15, 92/18, 19, 23, 24, 28, 131
See application file for complete search history.

(56) References Cited

U.S. PATENT DOCUMENTS

| | | | | | |
|---|---|---|---|---|---|
| 2,118,890 | A | * | 5/1938 | Maes | 92/19 |
| 2,689,157 | A | * | 9/1954 | Di Censo | 108/5 |
| 3,848,515 | A | * | 11/1974 | Gardineer et al. | 91/184 |
| 3,889,576 | A | * | 6/1975 | Sheffer et al. | 91/394 |
| 4,116,113 | A | * | 9/1978 | Leclerc | 92/24 |
| 4,524,676 | A | * | 6/1985 | Rogers | 91/43 |
| 4,697,680 | A | * | 10/1987 | Faber et al. | 192/86 |
| 5,048,656 | A | * | 9/1991 | Braun | 92/24 |

* cited by examiner

*Primary Examiner*—Igor Kershteyn
(74) *Attorney, Agent, or Firm*—Hedman & Costigan; James V. Costigan

(57) ABSTRACT

The invention concerns a pneumatic and/or hydraulic actuator. The pneumatic and/or hydraulic actuator is one in which the run of a driving shaft, which is pneumatically operated by a piston, can vary on the basis of the insertion in the body of the actuator or at least one cylinder, so that the body of the cylinder forms a barrier along the run of the driving shaft causing the stoppage of the shaft itself.

2 Claims, 3 Drawing Sheets

ACTUATOR WITH A VARIABLE RUN

TITLE OF THE INVENTION

The present invention relates to a pneumatic and/or hydraulic actuator.

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

In particular, the present invention relates to a hydraulic actuator which can be used for activating sensors, valves, etc. . . . in industrial plants.

BACKGROUND OF THE INVENTION

Various hydraulic actuators in which a shaft is pneumatically moved along an axis by the movement of a piston operating by means of compressed air, have been proposed in the known art.

The run of the shaft substantially corresponds to the run of the piston and exclusively creates two pre-established positions in the project phase of said type of actuator.

The Applicant considered the possibility of varying the run of the driving shaft of an actuator operating with air/oil, in relation to the possible applications which the actuator itself can have.

BRIEF SUMMARY OF THE INVENTION

The Applicant has produced an actuator in which the run of a driving shaft, which is pneumatically operated by a piston, can vary on the basis of the insertion in the body of the actuator of at least one cylinder, so that the body of said cylinder forms a barrier along the run of the driving shaft causing the stoppage of the shaft itself.

A series of differentiated runs of the driving shaft, preselected by the pneumatic and/or hydraulic activation of said cylinders, are produced by the presence of one or more housings, situated along the body of the actuator, in which each cylinder can be inserted.

An aspect of the present invention relates to a pneumatic/hydraulic actuator comprising a container body, a driving shaft, inserted in a cylindrical housing or pass-through hole of said container body, said driving shaft being mobile along a longitudinal axis of the actuator and which can be hydraulically operated, characterized in that it comprises at least one pass-through hole situated on said container body which is substantially orthogonal to said moving axis of the shaft in which a cylinder is integrated, which can operate in such a way as to intercept the run of the driving shaft, creating a pre-established run thereof along said longitudinal axis.

BRIEF DESCRIPTION OF THE SEVERAL VIEWS OF THE DRAWINGS

The characteristics and advantages of the actuator according to the present invention will appear more evident from the following illustrative but non-limiting description of one of its typical embodiments, referring to the enclosed schematic drawings, in which:

FIG. 3 schematically illustrates a section of the actuator of FIG. 1 according to the present invention, along the plane a.

Figure 1:
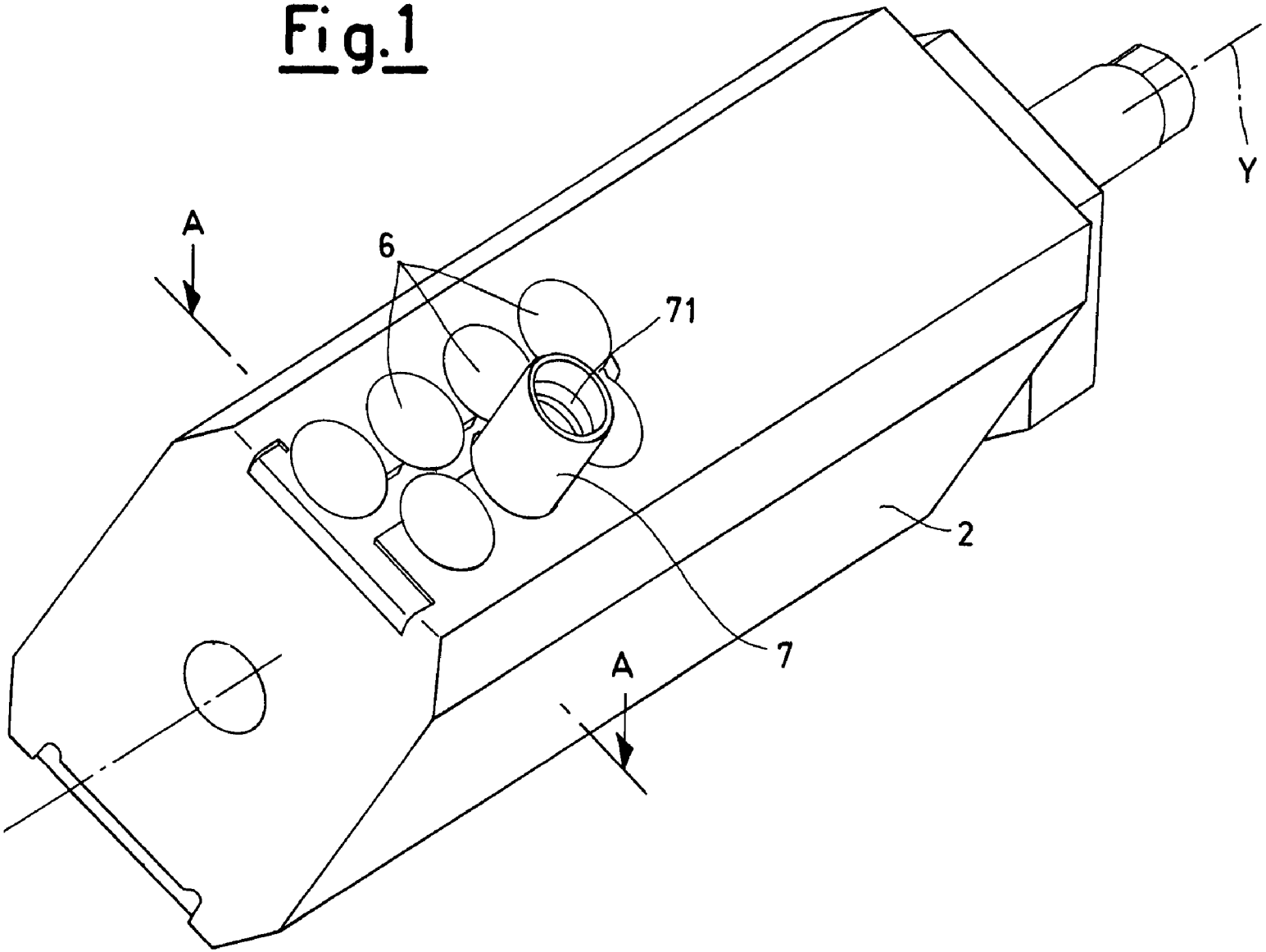
FIG. 1 schematically illustrates, in a perspective view, a pneumatic and/or hydraulic actuator according to the present invention.
Figure 2:
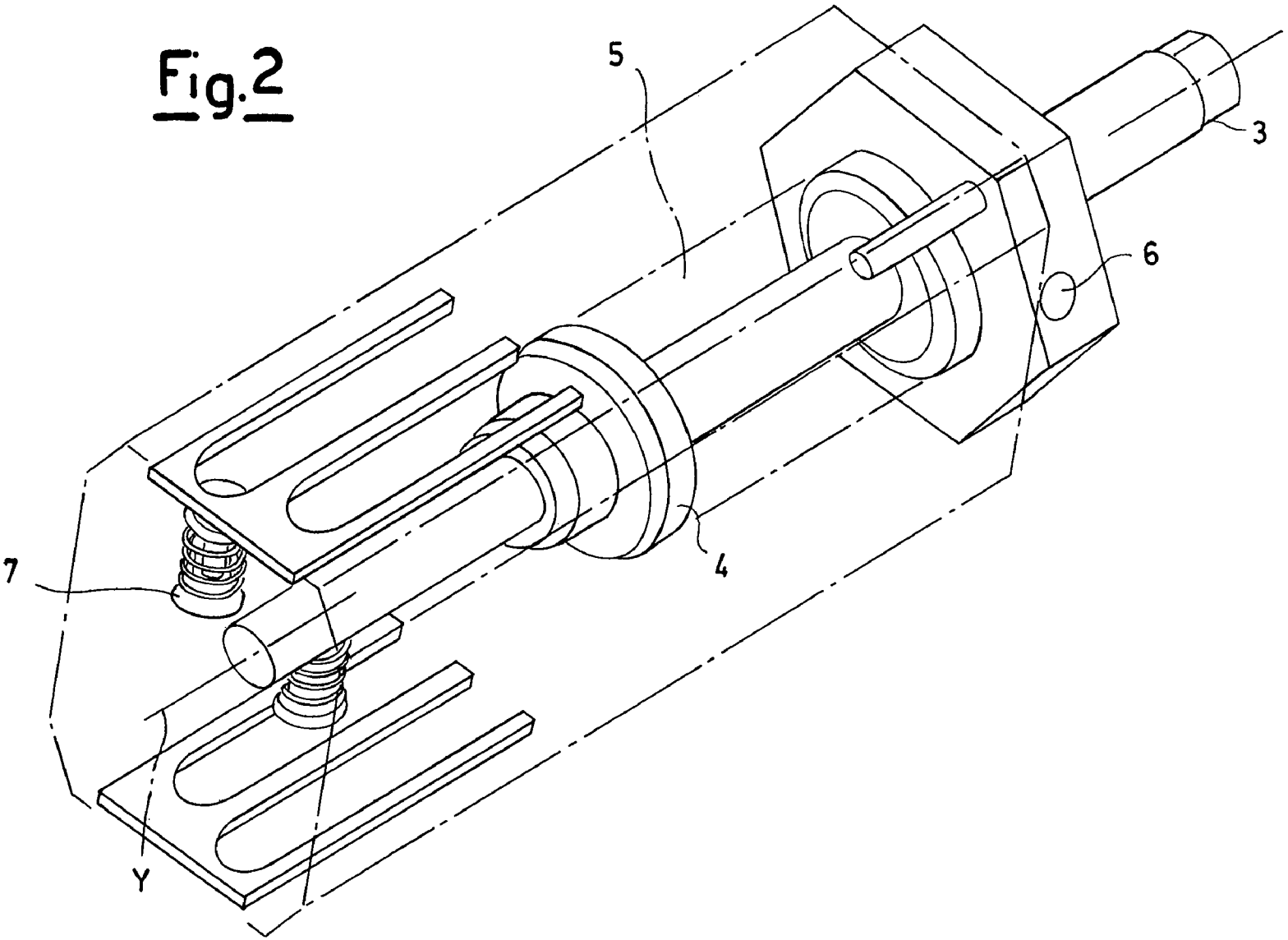
FIG. 2 schematically illustrates, in a perspective view, the hydraulic actuator of FIG. 1 without the outer casing.

With reference to the above figures, the hydraulic actuator comprises a container body 2 which has a substantially parallelepiped form and a driving shaft 3 inserted in a cylindrical housing or pass-through hole of said container body. Said driving shaft is moveable along a longitudinal axis Y of the actuator.

DETAILED DESCRIPTION OF THE INVENTION

For the purposes of the present invention, the container body can be equivalently produced in a cylindrical, hexagonal, octagonal or more generally polyhedral form.

A hydraulic/pneumatic piston is situated inside said container body, which causes the movement of said driving shaft 3, comprising a sealing ring 4 integral with said shaft which moves in a suitable housing 5, preferably cylindrical, positioned inside the container body 2. The cylindrical housing is filled, in a conventional manner, with compressed air by means of an intake socket 6 for the introduction of compressed air into the actuator and, the air is expelled from this housing by means of an outlet socket (not illustrated).

On the container body of said actuator, there is at least one pass-through hole 6, which is substantially orthogonal to said movement axis of the shaft in which a hydraulically operated cylinder 7 is integrated, which intercepts the run of the shaft, for example by means of the ring 5 creating a run-end for the movement of the driving shaft. On the container body, there is preferably a series of pass-through holes, situated along the container body, in each of which a cylinder 7 is integrated, so that by selectively activating each cylinder, a series of differentiated runs of the driving shaft of the actuator can be effected.

If the container body is parallelepiped or hexagonal, or generally has a form characterized by flat side surfaces, said pass-through holes for the cylinders can be advantageously situated on more than one of the surfaces so as to increase the possibility of having various differentiated runs of the driving shaft.

Said cylinder preferably comprises a corresponding ring 71, suitable for creating an inlet for a tub (not shown) of compressed air, a pin 72 which slides inside said cylinder, having a head 721 which acts as a thrust surface for the compressed air introduced into the cylinder from said tube. The leg 722 of the pin is in contact with the ring 5 causing the stoppage of the movement of the driving shaft.

Figure 3:
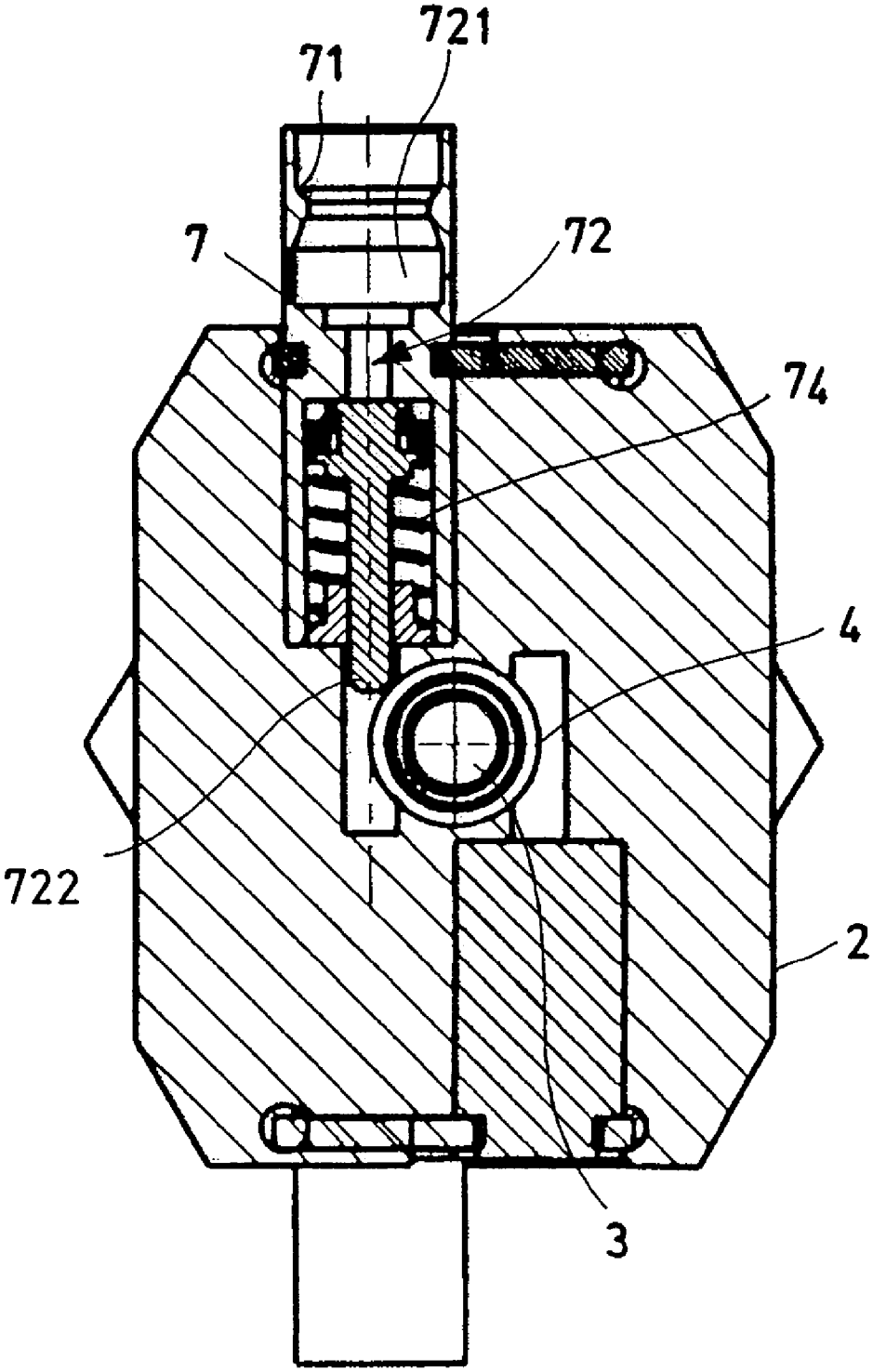

In the lower part of the pin 72, there is a corresponding element suitable for contrasting the upper thrust of compressed air. In the example shown in FIG. 3 said element consists of a spring 74. Alternatively, said corresponding element can be obtained by inserting pressurized air also in the lower part of the cylinder below the head of the pin, thus creating a chamber containing pressurized air; in this case, the pin moves in the cylinder on the basis of a pressure differential between the upper and lower part of the pin itself.

Alternatively, the movement of the pin can be obtained by means of a magnetic drive and/or electric drive.

All the cylinders can be constrained in the pass-through holes by means of at least one stoppage fork 9 which is inserted longitudinally.

The invention claimed is:

1. An actuator with a variable run comprising a container body (2) a driving shaft (3), inserted in a cylindrical housing or pass-through hole of said container body, said driving shaft being moveable along a longitudinal axis (Y) of the actuator and operating pneumatically, characterized in that it comprises at least one pass-through hole situated on said container body substantially orthogonal to said movement axis of the shaft in which a cylinder (7) is integrated which operates so as to intercept the run of the driving shaft, creating a pre-established run thereof along said longitudinal axis (Y), the actuator further comprising a pin (72), sliding inside said cylinder, having a leg (722) which intercepts the run of the corresponding shaft when the pin is moving towards the inside of the actuator body in the direction of said shaft, said actuator further characterized in that when the leg of said pin is moved, it comes into contact with said sealing ring causing a run-end for the movement of the driving shaft.

2. An actuator with a variable run comprising a container body (2) a driving shaft (3), inserted in a cylindrical housing or pass-through hole of said container body, said driving shaft being moveable along a longitudinal axis (Y) of the actuator, characterized in that it comprises at least one pass-through hole situated on said container body substantially orthogonal to said movement axis of the shaft in which a cylinder (7) is integrated which operates so as to intercept the run of the driving shaft, creating a pre-established run thereof along said longitudinal axis (Y), the actuator further characterized in that inside said container body there is a hydraulic piston which causes the movement of said driving shaft, comprising a sealing ring (4) integral with said shaft which moves in an appropriate housing (5) which is filled with pressurized air, said actuator further characterized in that when the leg of said pin is moved, it comes into contact with said sealing ring causing a run-end for the movement of the driving shaft.

* * * * *